US005528275A

United States Patent [19]

Shinya et al.

[11] Patent Number: 5,528,275

[45] Date of Patent: Jun. 18, 1996

[54] GRADATIONAL PRINTING METHOD

[75] Inventors: Tadao Shinya; Yutaka Endou, both of Yokohama, Japan

[73] Assignee: Victor Company of Japan, Ltd., Yokohama, Japan

[21] Appl. No.: 218,780

[22] Filed: Mar. 28, 1994

[30] Foreign Application Priority Data

Mar. 26, 1993 [JP] Japan ..... 5-092569

[51] Int. Cl.[6] ..... B41J 2/35

[52] U.S. Cl. ..... 347/183; 347/180; 347/181; 347/182

[58] Field of Search ..... 347/211, 180, 347/181, 182, 183, 184; 400/120.05, 120.06, 120.07

[56] References Cited

U.S. PATENT DOCUMENTS 4,875,056 10/1989 Ono ..... 347/180

FOREIGN PATENT DOCUMENTS 57-27771 2/1982 Japan .

62-261461 11/1987 Japan .

62-271763 11/1987 Japan .

63-1559 1/1988 Japan .

*Primary Examiner*—Huan H. Tran

*Attorney, Agent, or Firm*—Lowe, Price, Leblanc & Becker

[57] ABSTRACT

A gradational printing method for performing a gradational printing by energizing a plurality of heat emitting elements arranged on a thermal head correspondingly to respective bits of digital gradation data representing a gray level. In case of this method, the plurality of heat emitting elements are divided into two or more blocks and the blocks are energized correspondingly to different bits of the digital gradation data. Thus, an energizing time, during which a maximum current should be supplied, can be reduced. Further, the weight of the printer can be light. Moreover, if the maximum electric current of a printer is equal to that of the conventional method, the duration thereof can be equal to the minimum duration of the energizing pulses corresponding to the bits of the gradation data. Consequently, the capacities of a power supply and a printer employing this method can be small. Further, the size and manufacturing cost of the power supply and the printer can be small.

6 Claims, 12 Drawing Sheets

FIG. 11

| TRANSFER COUNTER / ADDRESS COUNTER | 0 | 1 | 2 | 3 | 4~ |
|---|---|---|---|---|---|
| 0 ~ 255 (BLOCK 1) | 0 | 1 | 2 | 3 | 7 |
| 256 ~ 511 (BLOCK 2) | 1 | 2 | 3 | 0 | 7 |
| 512 ~ 767 (BLOCK 3) | 2 | 3 | 0 | 1 | 7 |
| 768 ~1023 (BLOCK 4) | 3 | 0 | 1 | 2 | 7 |
| 1024 ~ | 7 | 7 | 7 | 7 | 7 |

(SELECTION SIGNAL REPRESENTS 3-BIT DATA)

FIG. 12

| TRANSFER COUNTER | 0 | 1 | 2 | 3 |
|---|---|---|---|---|
| ADDRESS COUNTER | 0, 1, ···, 1023, 1024, ~ | 0, 1, ·····, 511, 512, ·····1023, 1024, ~ | 0, 1, ·····, 511, 512, ·····1023, 1024, ~ | 0, 1 ·····, 511, 512··· |
| EN1 | 0, → 0, 0, ~ | 0, → 0, 1, → 1, 0 → 0, 0, ~ | 0, → 0, 1 → 1, 0, → 0, 0, ~ | 1, → 1, 0, |
| EN2 | 0, → 0, 0, ~ | 0, → 0, 1 → 1, 0, → 0, 0, ~ | 1, → 1, 0, → 0, 0, ~ | 1, → |
| EN3 | 0, → 0, 0, ~ | 1, → 1, 0, → 0, 0, ~ | 1, → 1, 0, ~ | 0, → 0, 1, |
| EN4 | 0, → 0, 0, ~ | 1, → 1, 0, ~ | 0, → 0, 1 → 1, 0 → 0, 0, ~ | 0, → 0, 1 → 1, 0, |

GRADATIONAL PRINTING METHOD

BACKGROUND OF THE INVENTION

1. Field of the Invention

This invention relates to a gradational printing method for performing a gradational printing by using heat emitting resistors (namely, heating elements) arranged on a thermal printing head (hereunder sometimes referred to simply as a thermal printhead or a thermal head).

2. Description of The Related Art

A widely-known conventional method for performing a gradational printing on a heat sensitive paper or the like is to print a gradational image on a printing paper through a transfer paper (or directly on a thermally sensitive paper) by applying pulses, the width of each of which corresponds to the weight of each bit of digital data representing gray levels, to a plurality of heating elements linearly arranged.

FIGS. 9(*a*) to 9(*d*) are timing charts for illustrating an example of such a conventional gradational printing method. Incidentally, this example is obtained by expanding the number of bits of gradation data up to 4, which data is used in a method disclosed in the Japanese Unexamined Patent Publication (Kokai Tokkyo Koho) Official Gazette No. S57-27771. In case of this method, pulses T0, T1, T2 and T3 are made to correspond to bit 0, bit 1, bit 2 and bit 3 (namely, bit positions 0, 1, 2 and 3 (corresponding to $2^0$, $2^1$, $2^2$ and $2^3$, respectively)) of 4-bit gradation data inputted as what is called as head data, respectively. (Incidentally, in the instant application, values indicated by the bit 0, bit 1, bit 2 and bit 3 are referred to simply as $2^0$-bit, $2^1$-bit, $2^2$-bit and $2^3$-bit, respectively.) Further, energizing pulses EN1 to EN4 are generated latching the pulses T0, T1, T2 and T3 serially in response to latch pulses LT. Moreover, a gradational printing is performed by continuously applying all of pulse currents to heating elements. Furthermore, each of the pulse currents is applied thereto substantially simultaneously with the generation of the corresponding energizing pulse. Additionally, in FIG. 9(*d*), $I_{TH}$ denotes a head current; and $I_M$ a maximum current.

FIGS. 10(*a*) to 10(*d*) are timing charts for illustrating another example of the conventional gradational printing method, which is disclosed in the Japanese Unexamined Patent Publication (Kokai Tokkyo Koho) Official Gazette No. S63-1559. (Incidentally, preheating pulses are not shown in these figures.) As is apparent from these figures, in case of this method, the pulses T0, T1, T2 and T3 are applied to heating elements intermittently. Further, each of these pulses is applied thereto substantially simultaneously with the generation of the corresponding energizing pulse.

Meanwhile, in cases of the aforesaid printing methods, if the value of a head current at the time of energizing all of the heating elements of the thermal head simultaneously is $I_M$, a power supply for the head should be able to supply the current of $I_M$ thereto without variation in voltage for a period of (T0+T1+T2+T3) (namely, a sum of the pulse durations of the pulses T0, T1, T2 and T3) in case of the method of FIGS. 9(*a*) to 9(*d*) (incidentally, in case of the method of FIGS. 10(*a*) to 10(*d*), for the longest pulse duration (namely, T3) among those of the pulses T0 to T3). As the result, the power supply for the head should have large capacity. Consequently, the size and manufacturing cost of a printer employing such a conventional method should be large. The present invention is accomplished to eliminate the drawbacks of the conventional methods.

It is, therefore, an object of the present invention to provide a gradational printing method which energizes each of blocks of heat emitting elements of a thermal printhead correspondingly to a different bit of gradation data representing a gray level.

SUMMARY OF THE INVENTION

To achieve the foregoing object and in accordance with an aspect of the present invention, there is provided a gradational printing method for performing a gradational printing by energizing a plurality of heat emitting elements arranged on a thermal head correspondingly to respective bits of digital gradation data representing a gray level, wherein the plurality of heat emitting elements are divided into two or more blocks and the blocks are energized correspondingly to different bits of the digital gradation data.

Thus, an energizing time, during which a maximum current should be supplied, can be reduced. Further, the weight of the printer can be light. Moreover, if the maximum electric current of a printer is equal to that of the conventional method, the duration thereof can be equal to the minimum duration of the energizing pulses corresponding to the bits of the gradation data. Consequently, the capacities of a power supply and a printer employing this method can be small. Further, the size and manufacturing cost of the power supply and the printer can be small.

Moreover, a maximum head current can be restrained by limiting the number of the blocks of the heat emitting elements energized simultaneously. Thereby, the capacities, size and manufacturing cost of the power supply and the printer can be further smaller.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and .in which:

FIG. 5(*b*) is an enlarged view of latch pulses of FIG. 4(*b*);

FIG. 8(*b*) is an enlarged view of latch pulses of FIG., 7(*b*);

FIG. 11 is a diagram for illustrating the values represented by a selection signal correspondingly to the values held in a transfer counter and an address counter, respectively; and FIG. 12 is a diagram for illustrating the states of energizing pulses EN1 to EN4 in case where a block of heat emitting elements corresponding to $2^1$-bit and another block of heat emitting elements corresponding to $2^0$-bit are not energized simultaneously.

DETAILED DESCRIPTION OF THE PREFERRED EMBODIMENTS

Hereinafter, the preferred embodiments of the present invention will be described in detail by referring to the accompanying drawings.

Figure 1:
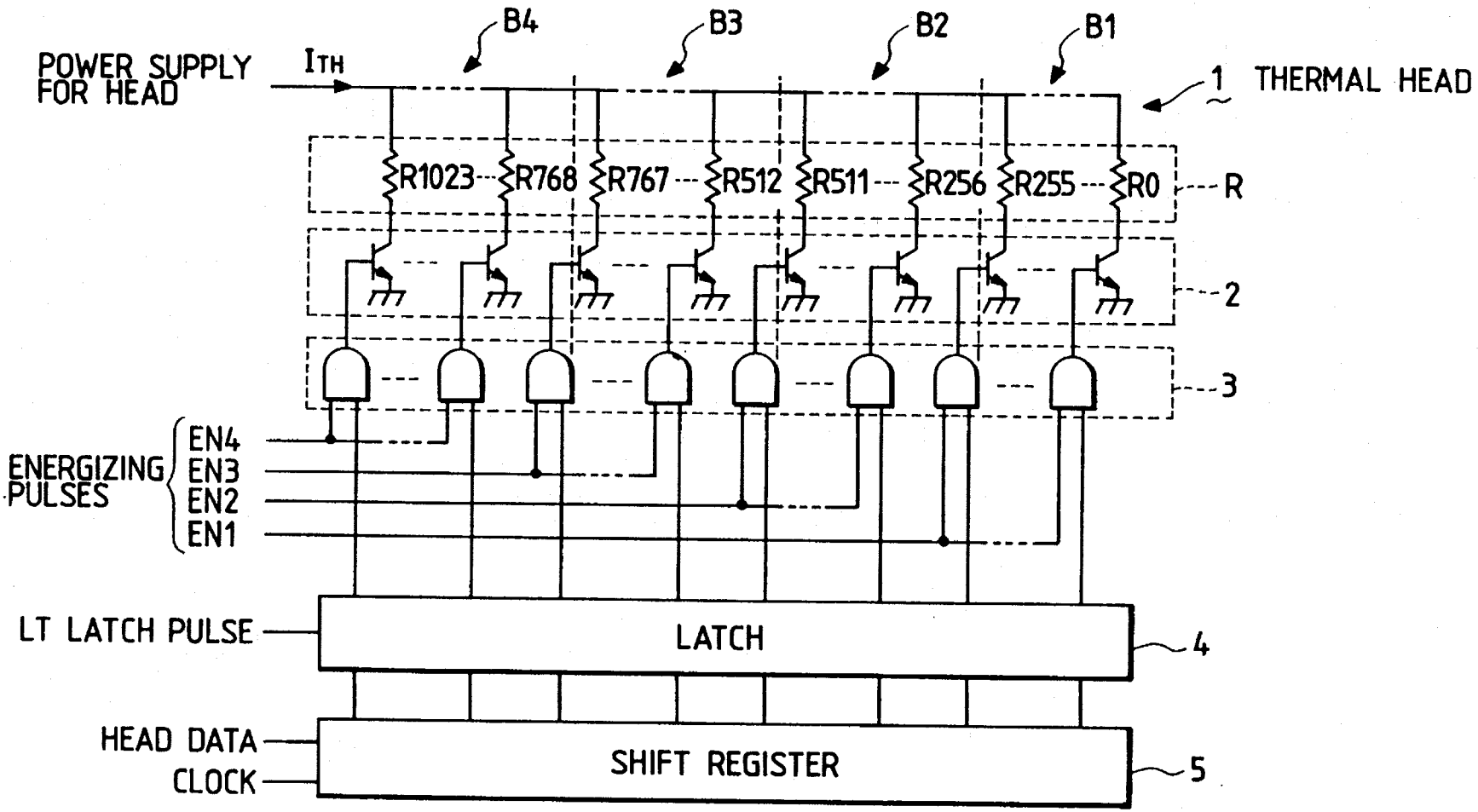
FIG. 1 is a circuit diagram for illustrating the configuration of an ordinary thermal head.
Figure 2:
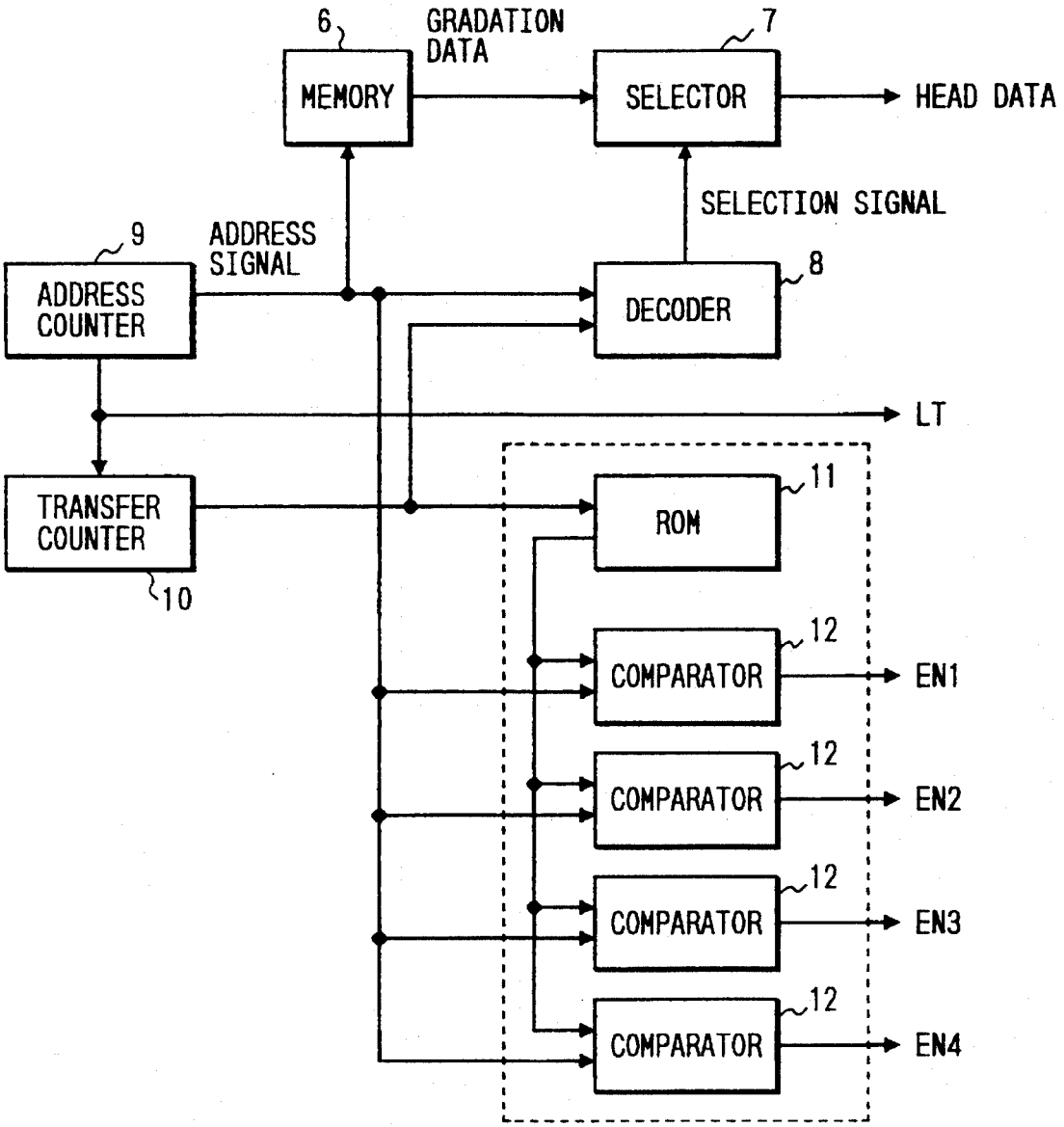
FIG. 2 is a schematic block diagram for illustrating the configuration of a control circuit according to the present invention to control the thermal head of FIG. 1.
Figure 3:
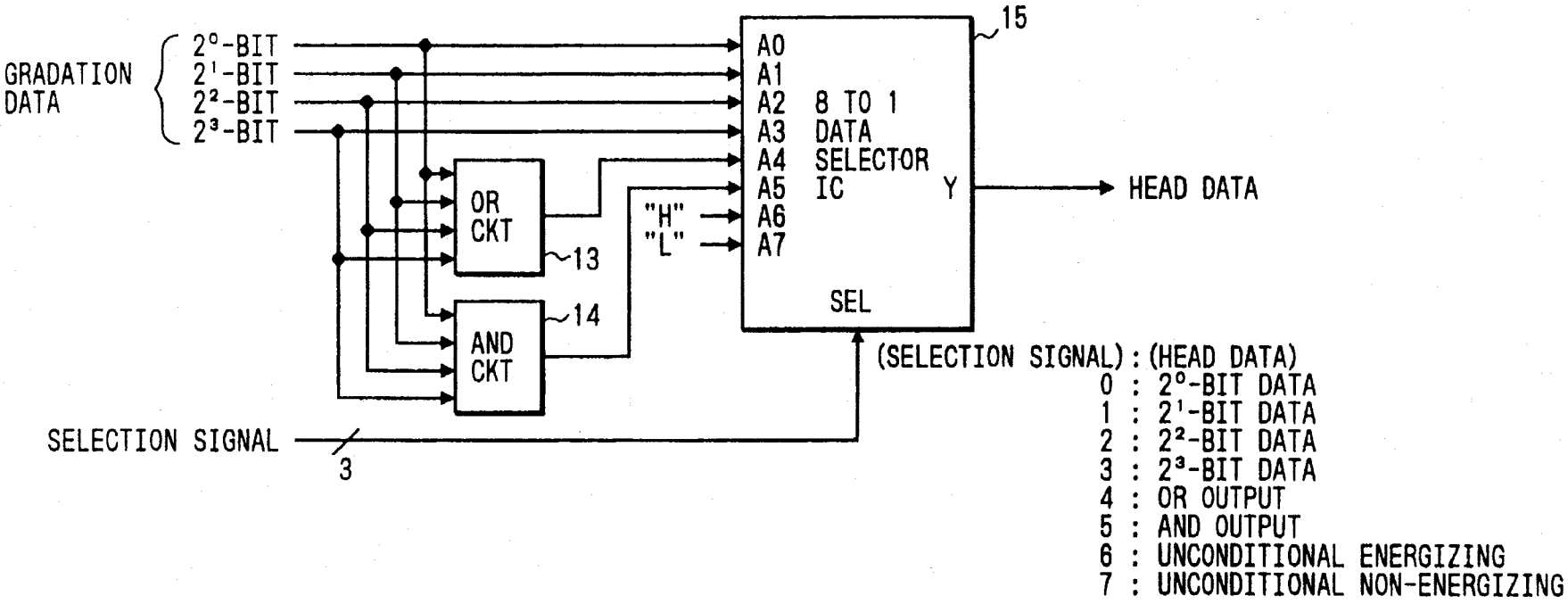
FIG. 3 is a schematic block diagram for illustrating the detail construction of a selector of the control circuit of FIG. 2.

FIG. 1 is a circuit diagram for illustrating the configuration of an ordinary thermal head. Further, FIG. 2 is a schematic block diagram for illustrating the configuration of a control circuit according to the present invention to control the thermal head of FIG. 1. Moreover, FIG. 3 is a schematic block diagram for illustrating the detail construction of a selector of the control circuit of FIG. 2. Furthermore, FIGS. 4(*a*) to 4(*d*) are timing charts for illustrating the timing of printing in case of employing a gradational printing method (namely, the first embodiment) of the present invention and the characteristics of a supply current. Additionally, FIG. 5(*a*) is an enlarged view of head data of FIG. 4(*a*). Further, FIG. 5(*b*) is an enlarged view of latch pulses of FIG. 4(*b*).

First, before explaining the method of the present invention, the configurations of a thermal head and a control circuit therefor employed for performing the method of the present invention will be described in detail hereinbelow.

As shown in FIG. 1, the thermal head 1 is connected to a power supply therefor and is provided with a plurality of heat emitting elements R comprised of, for example, resistors arranged linearly. Further, a drive transistor 2 for driving each of the heat emitting elements, which consists of, for instance, an NPN transistor, is connected to each of the heat emitting elements R. In case of this thermal head, a total number of heat emitting elements R for example, 1024. Further, these heat emitting elements are designated by reference characters R0 to R1023. Moreover, these heat emitting elements are divided (or partitioned) into two or more blocks. In this case, the heat emitting elements are partitioned into four blocks each of which comprises 256 elements thereof. Further, energizing pulses EN1 to EN4 are applied to each of the blocks. Moreover, the heat emitting elements R0 to R255 are assigned to a first block B1. Furthermore, the heat emitting elements R256 to R511 are assigned to a second block B2. Additionally, the heat emitting elements R512 to R787 are assigned to a third block B3. Further, the heat emitting elements R768 to R1023 are assigned to a fourth block B4.

Moreover, an output terminal of each of logic gates 3 for controlling the transistors 2, which consists of, for example, an AND circuit, is connected to the base of each of the transistors 2 such that a current is supplied to each of the transistors 2 only for a period of the duration of each of the energizing pulses EN1 to EN4. Furthermore, the energizing pulse EN1 is inputted to one of input terminals of the logic gate 3 corresponding to the first block B1. The energizing pulse EN2 is inputted to one of input terminals of the logic gate 3 corresponding to the second block B2. Further, the energizing pulse EN3 is inputted to one of input terminals of the logic gate 3 corresponding to the third block B3. Furthermore, the energizing pulse EN4 is inputted to one of input terminals of the logic gate 3 corresponding to the fourth block B4. Additionally, an output terminal of the latch 4 for holding head data for a predetermined period of time is connected to the other of the input terminals of each of the logic gates 3. Further, a latch pulse LT is inputted to the latch 4.

In FIG. 1, reference numeral 5 denotes a shift register to which a clock signal and serial head data are inputted. The shift register 5 converts the head data serially transferred thereto into parallel data and then outputs the parallel data to the latch 4.

Turning to FIG. 2, there is shown a control circuit for controlling the thermal head of FIG. 1. In FIG. 2, reference numeral 6 designates a memory for storing 4-bit gradation data of one line; 7 a selector; and 8 a decoder. The selector 7 selects predetermined bits of gradation data outputted from the memory 6 according to a selection signal outputted from the decoder 8. Further, reference numeral 9 denotes an address counter for indicating addresses used to read gradation data of one line from the memory 6. The decoder 8 outputs a predetermined selection signal for a period of time (hereunder sometimes referred to as an address period) predetermined correspondingly to addresses indicated by memory address signals outputted from the address counter 9. Moreover, reference numeral 10 designates a transfer counter for counting the number of times of transferring data to the head and for outputting a signal which indicates the counted number of times of transferring data; 11 a read-only memory (ROM) for storing and outputting energizing-time data representing periods of time (namely, energizing times or periods), during each of which a corresponding one of the blocks B1 to B4 is energized, according to the number of times of transferring data to the head; and 12 comparators for comparing the energizing-time data with outputs of the address counter 9 and outputting the energizing pulses EN1 to EN4 to the blocks B1 to B4 of the head, respectively. Incidentally, the number of the comparators 12 is equal to the number of the blocks, namely, 4 in this case.

Further, FIG. 3 is a schematic block diagram for illustrating the configuration of the selector 7 of the control circuit of FIG. 2. This selector 7 includes, for example, a known integrated circuit (IC) 15. Moreover, 4-bit gradation data is inputted to each of the terminals A0 to A3 of the data selector IC 15. Further, an output of an OR circuit 13 for calculating a logical OR of the bits is inputted to the terminal A4 thereof. Moreover, an output of an AND circuit 14 for calculating a logical AND of the bits is inputted to the terminal A5 thereof. Furthermore, a signal representing a high level is inputted to the terminal A6 thereof and on the other hand, a signal representing a low level is inputted to the terminal A7 thereof. Additionally, a selection signal is inputted from the decoder 8 to the terminal SEL thereof.

Hereinafter, a method of the present invention to be performed by using the thermal head having the foresaid structure will be described in detail.

Incidentally, it is assumed that 4-bit gradation data of 1 line is preliminarily stored in the memory 6.

When starting on printing the data of 1 line, the address counter 9 and the transfer counter 10 are first reset. Thereafter, the address counter outputs memory address signals of 1 line sequentially in synchronization with clock signals (not shown). Then, the memory 6 outputs to the selector 7 the gradation data of 1 line in synchronization with the address signals.

On the other hand, in the decoder 8, each value (namely, selection data) represented by a selection signal to be outputted therefrom is preliminarily stored correspondingly to both of a value, which is indicated by the transfer counter 10, and another value (namely, an address), which is indicated by an address signal outputted from the address counter 9, as illustrated in FIG. 11. Further, the decoder 8 outputs a predetermined selection signal to the selector 7 for a predetermined address period correspondingly to (namely, in synchronization with) each of the blocks of the head. Moreover, a latch pulse LT is generated each time when the transfer of the gradation data corresponding to a block of the head is completed. At that time, the contents of the shift register 5 are held in the latch 4.

Figure 5A:
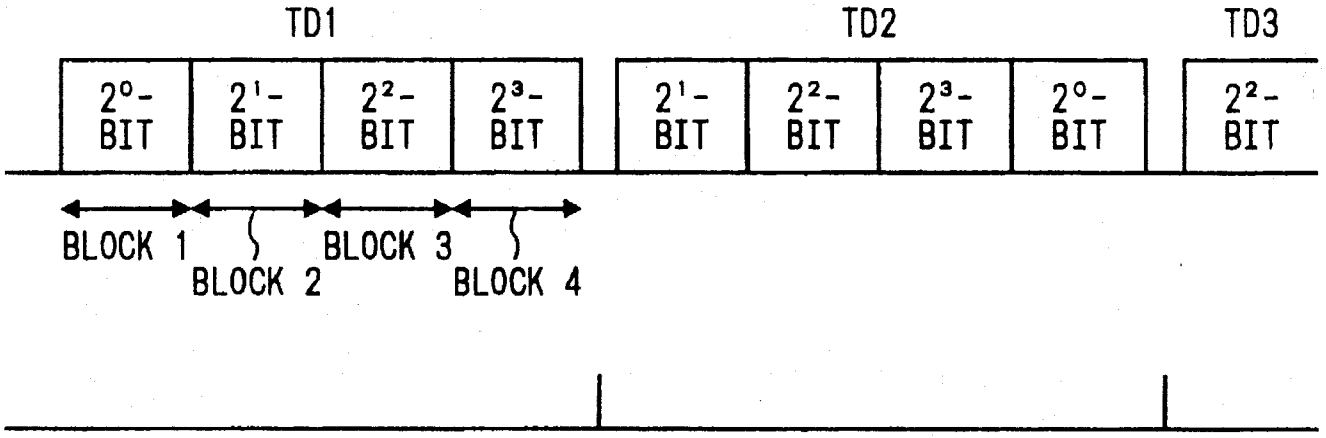
FIG. 5(*a*) is an enlarged view of head data of FIG. 4(*a*)

As the result, during a first data-transfer period TD1, $2^0$-bit of each of the gradation data is first transferred to the block B1 of the heat emitting elements R0 to R255 of the head as the head data for the block B1. Then, $2^1$-bit of each of the gradation data is transferred to the block B2 of the heat emitting elements R256 to R511 of the head as the head data for the block B2. Next, $2^2$-bit of each of the gradation data is transferred to the block B3 of the heat emitting elements R512 to R767 of the head as the head data for the block B3. Finally, $2^3$-bit of each of the gradation data is transferred to the block B4 of the heat emitting elements R768 to R1023 of the head as the head data for the block B4. FIGS. 5(*a*) and 5(*b*) illustrate such a data transfer.

When the first data transfer corresponding to the period TD1 is completed in this way, the address counter 9 outputs a latch pulse LT again. Further, the previous head data (namely, the head data transferred in the first data-transfer period TD1) is held in the latch 5. Moreover, the count held in the transfer is increased by 1.

Subsequently, a second data transfer is performed according to the selection signal indicating values illustrated in FIG. 11 during a second data-transfer period TD2. Simultaneously with this, energizing-time data indicating an energizing period corresponding to each of the blocks of the head is outputted from the ROM 11 to each of the comparators 12. Further, each of the comparators 12 compares the energizing-time data with the output of the address counter and outputs an energizing pulse EN1, EN2, EN3 or EN4 corresponding to the weight of each of the $2^0$-, $2^1$-, $2^2$- and $2^3$-bits.

Thus, the energizing pulses EN1 to EN4 as illustrated in FIG. 4(*c*) are outputted to the blocks B1 to B4 by repeatedly performing data transfers a predetermined number of times.

Namely, at a given time, the blocks B1 to B4 are simultaneously energized correspondingly to different ones of the $2^0$-, $1^1$-, $2^2$- and $2^3$-bits.

Figures 4A, 4B, 4C, 4D:
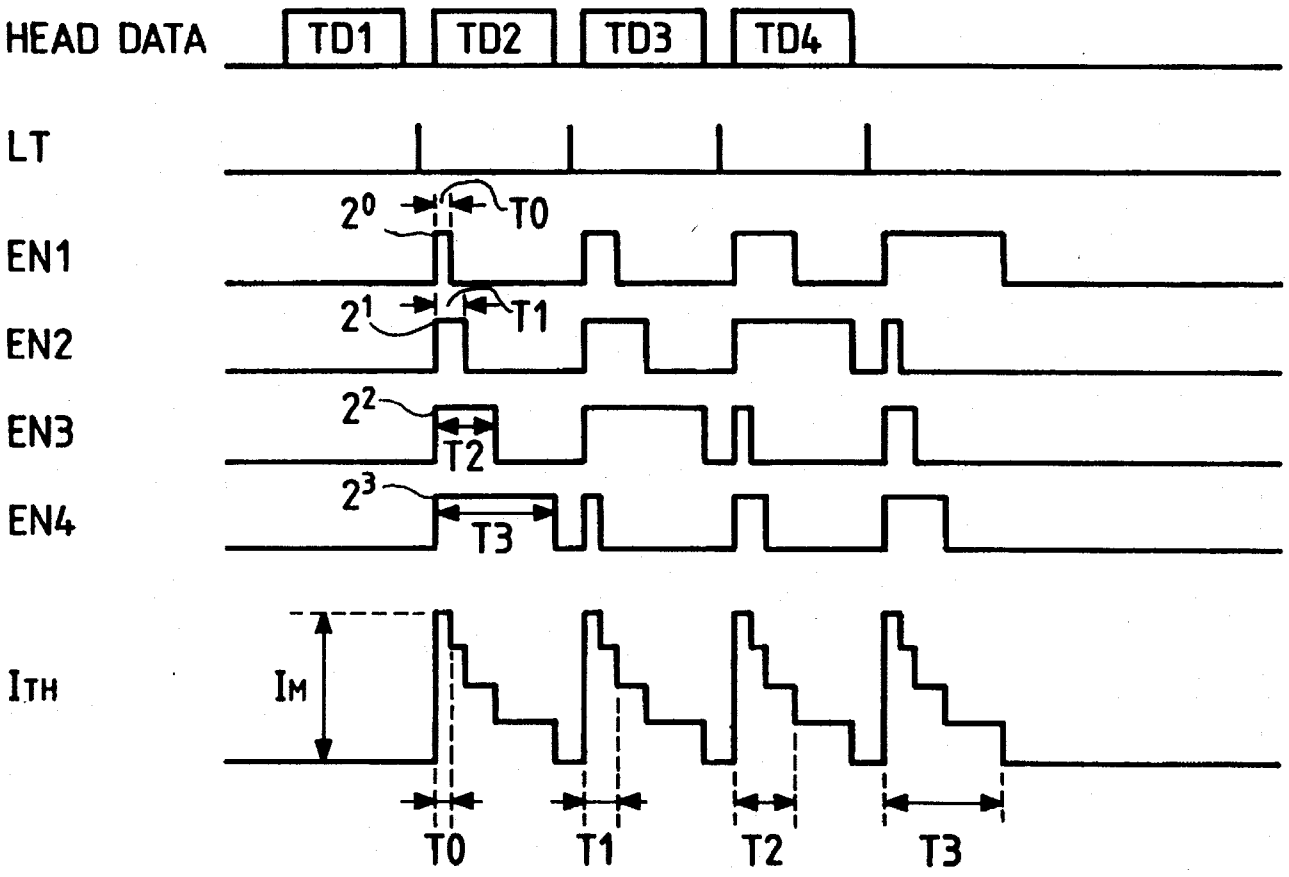
FIGS. 4(*a*) to 4(*d*) are timing charts for illustrating the timing of printing in case of employing a gradational printing method (namely, a first embodiment) of the present invention and the characteristics of a supply current.

The head current $I_{TH}$ flowing through the head at this time is a sum of electric currents respectively flowing the blocks B1 to B4 at the same time and changes as illustrated in FIG. 4(D).

Thus, although the order of energizing each heat emitting element varies with the corresponding block (namely, the corresponding one of the $2^0$-, $2^1$-, $2^2$- and $2^3$-bits), each heat emitting element is energized for a pulse duration corresponding to the weight of the corresponding bit. Thereby, a gradational printing of 1 line is performed.

Incidentally, the durations of the energizing pulses respectively corresponding to the $2^0$-, $2^1$-, $2^2$- and $2^3$-bits can be arbitrarily set correspondingly to the blocks B1 to B4 by using the data stored in the ROM 11. Thereby, desired gradation characteristics (namely, tone reproduction characteristics) can be obtained. Moreover, gradation characteristics corresponding to each of the blocks B1 to B4 can be corrected.

Figures 9A, 9B, 9C, 9D:
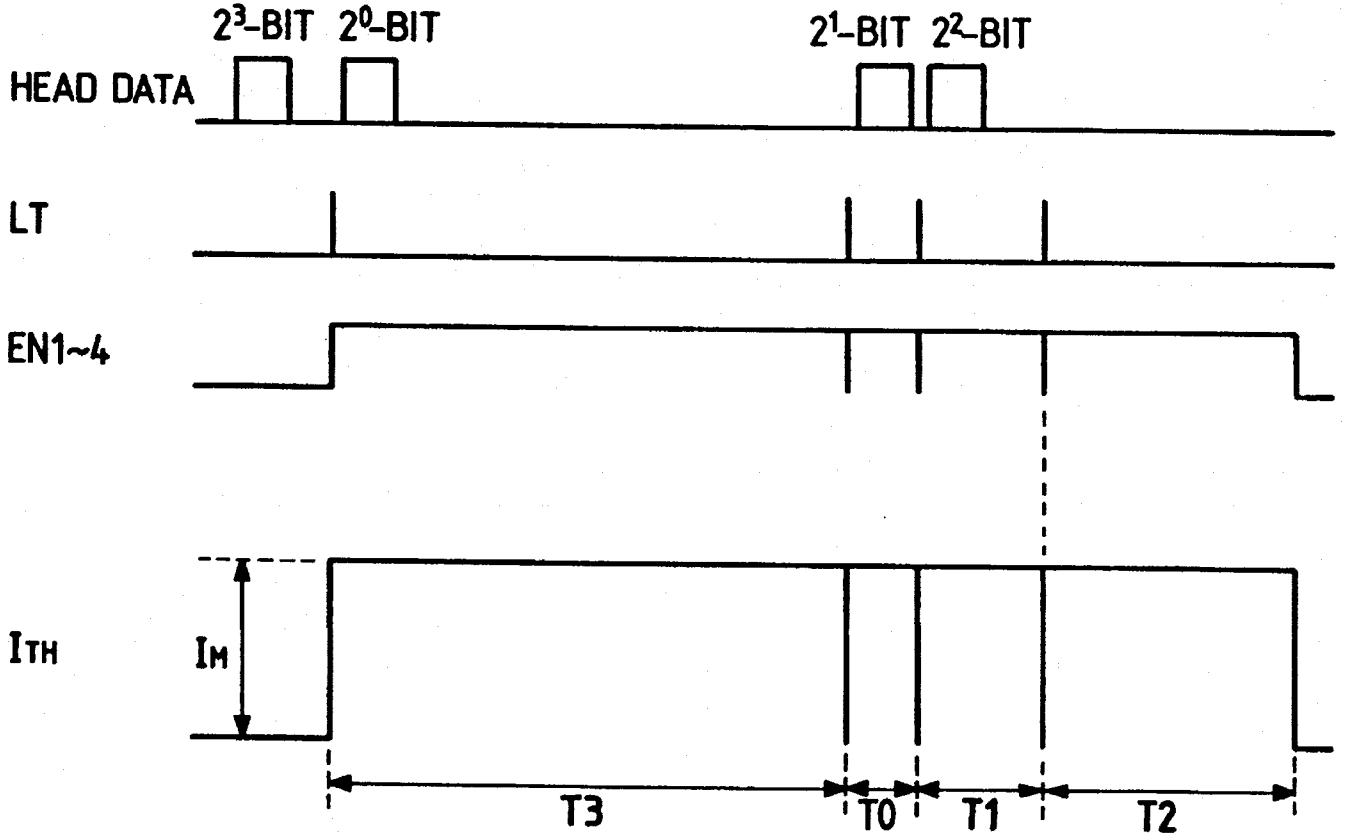
PRIOR ART FIG. 9(a)
FIGS. 9(*a*) to 9(*d*) are timing charts for illustrating the timing of printing in ease of employing an example of a conventional gradational printing method and the characteristics of a supply current.
Figures 10A, 10B, 10C, 10D:
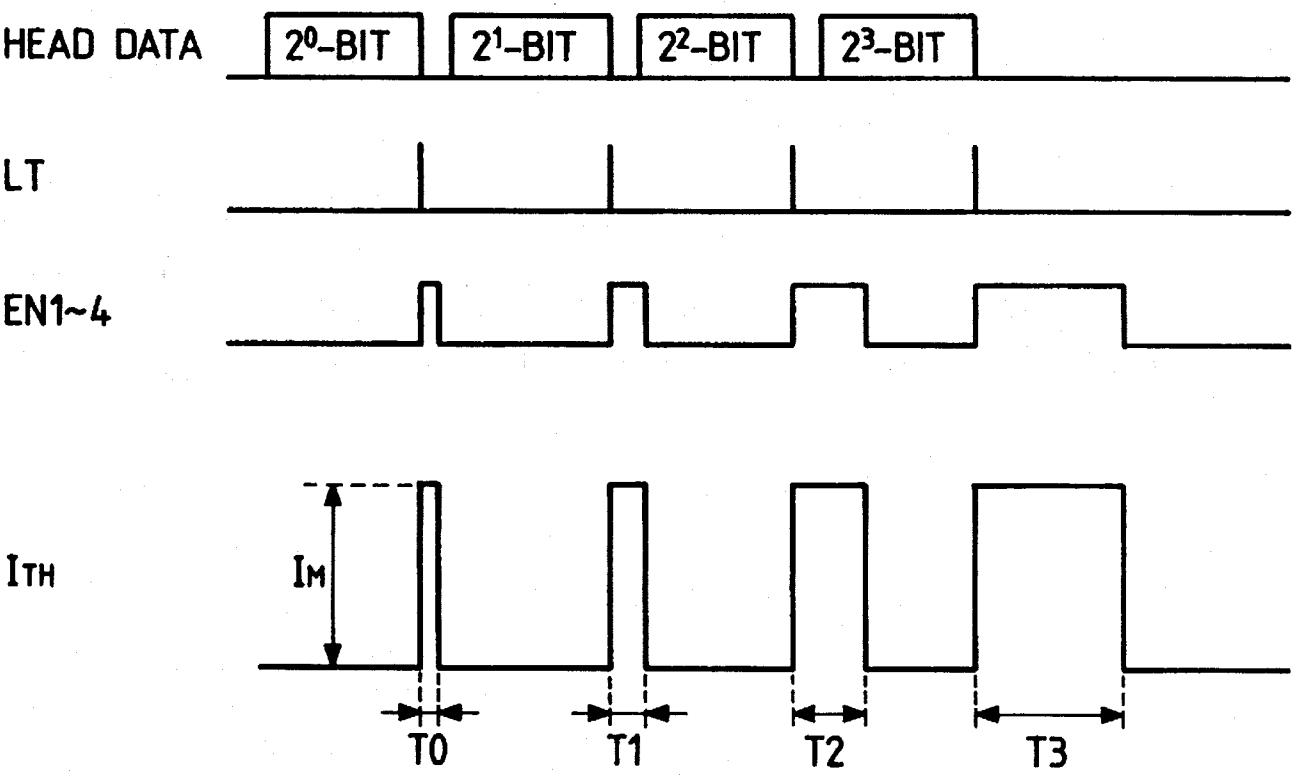
PRIOR ART FIG. 10(a)
FIGS. 10(*a*) to 10(*d*) are timing charts for illustrating the timing of printing in ease of employing another example of a conventional gradational printing method and the characteristics of a supply current.

In this manner, energizing periods, during which the heat emitting elements are energized, vary with the blocks (namely, with the $2^0$-, $2^1$-, $2^2$- and $2^3$-bits). Thus, although the maximum value $I_M$ of the head current $I_{TH}$ is equal to that in case of employing the conventional method (see FIGS. 9(*d*) and 10(*d*)), the duration of the maximum head current $I_M$ in case of this embodiment of the present invention is considerably small in comparison with the conventional method and is equal merely to the minimum one of the pulse durations of the energizing pulses corresponding to the $2^0$-, $2^1$-, $2^2$- and $2^3$-bits (namely, is equal to T0 in this case). As a consequence, the degree of freedom in designing the circuit can be increased. Moreover, the capacity of the power supply, as well as the size and manufacturing cost of the printer, can be reduced.

Incidentally, in case of the aforementioned embodiment, the output of the address counter 9 is inputted to the comparators 12 to generate the energizing pulses. The present invention is not limited to this. The energizing pulses can be controlled at a resolution higher (or lower) than a data-transfer frequency by, for example, providing a counter for the energizing pulses in the printer and inputting an output of this counter to the comparators 12.

Figures 6A, 6B, 6C, 6D:
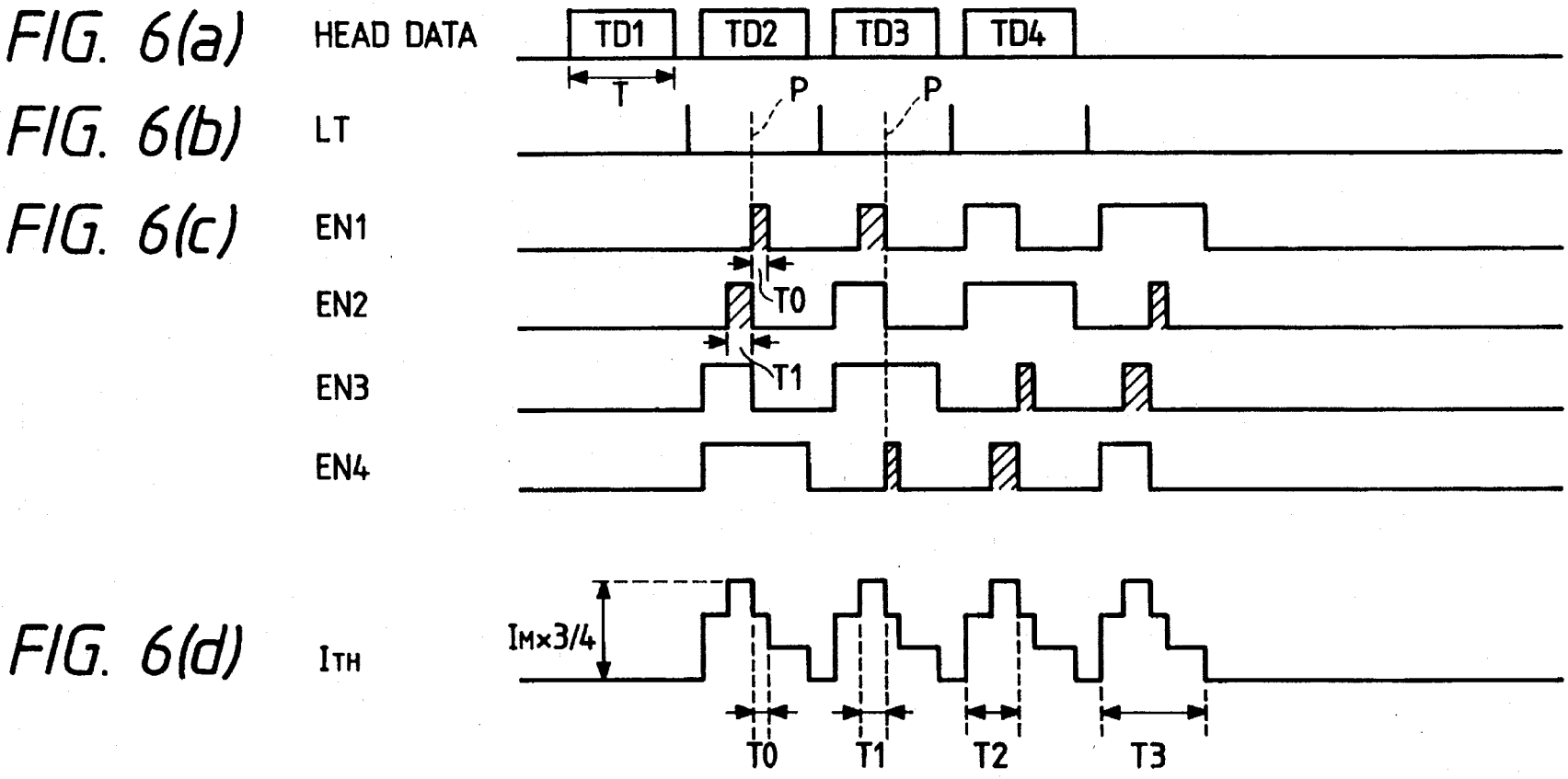
FIGS. 6(*a*) to 6(*d*) are timing charts for illustrating the timing of printing in case of employing another gradational printing method (namely, a second embodiment) of the present invention and the characteristics of a supply current.

Further, a portion indicated by dashed lines in FIG. 2 (namely, the ROM 11 and the comparators 12 of FIG. 2) may be comprised of a single ROM. In such a case, if each of the pulse durations T0 and T1 corresponding to $2^0$-bit and $2^1$-bit, respectively, is equal to or less than (½) of a data-transfer time T as shown in FIGS. 6(*a*) and 6(*d*), a pulse corresponding to one of these bits (for instance, the $2^0$-bit) may be generated in the direction of the end of the transfer by using the middle point P of the data-transfer time T as a starting point of this pulse and another pulse corresponding to the other bit (namely, the $2^1$-bit) may be also generated in the direction of the start of the transfer by using the middle point P as an end point of this pulse (incidentally, these pulses have the above described pulse durations T0 and T1, respectively). Thus the block of the heat emitting elements corresponding to the $2^0$-bit and the block of the heat emitting elements corresponding to the $2^1$-bit can not be energized simultaneously. Namely, these blocks can be energized at different times, respectively. FIG. 12 illustrates the output states (namely, the levels) of the energizing pulses EN1 to EN4 in such case.

Thus, in such a case, the blocks respectively corresponding to the $2^0$-bit and the $2^1$-bit can not emit heat simultaneously. As the result, the maximum number of the blocks energized simultaneously can be reduced to 3 from 4. As illustrated in FIG. 6(*d*), the maximum head current is only three-quarters the maximum head current $I_M$ in case of the aforesaid embodiment of the present invention. Consequently, the capacity of the power supply and the size of the printer can be further reduced.

Figures 7A, 7B, 7C, 7D:
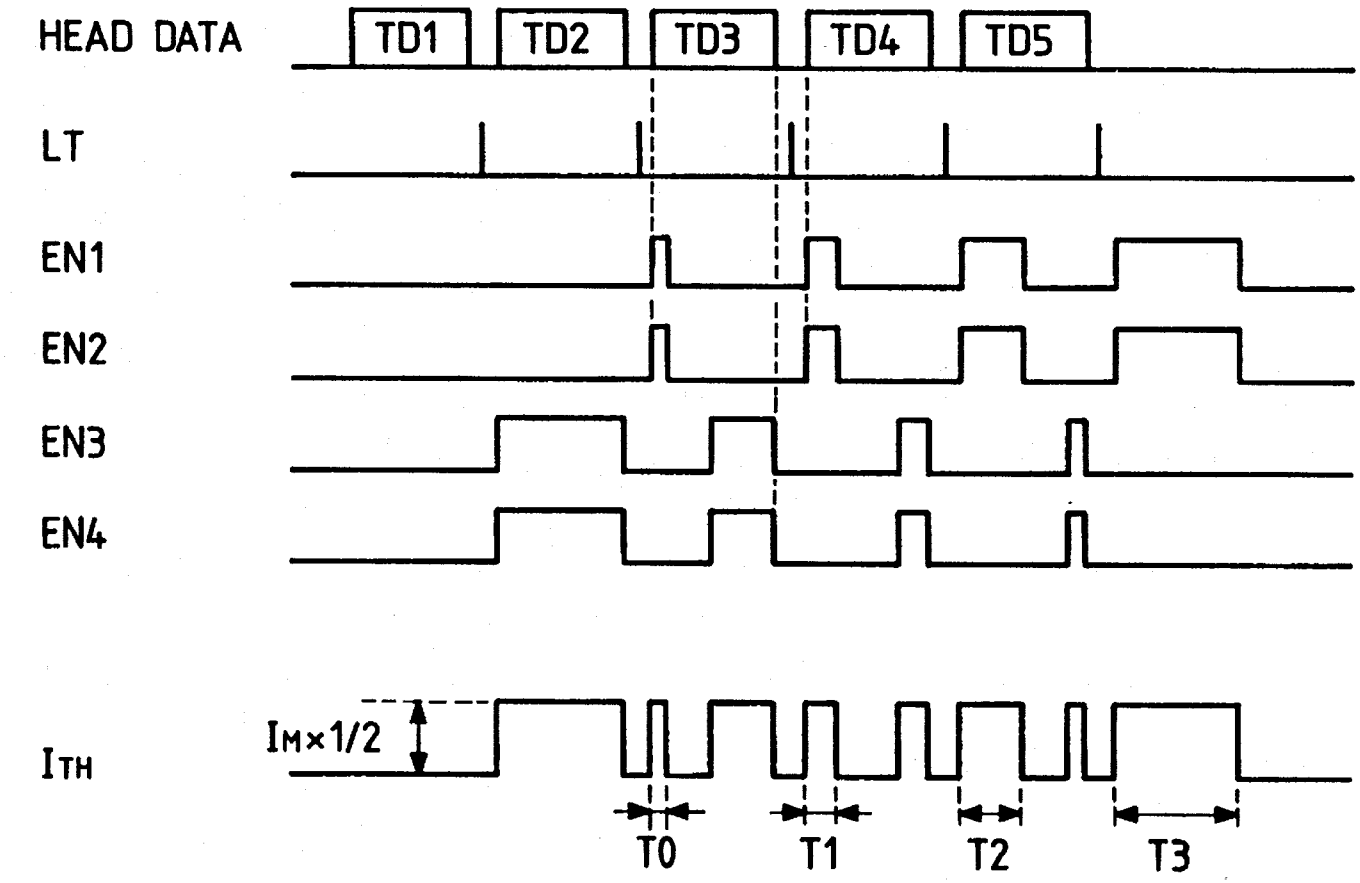
FIGS. 7(*a*) to 7(*d*) are timing charts for illustrating the timing of printing in case of employing still another gradational printing method (namely, a third embodiment) of the present invention and the characteristics of a supply current.
Figures 8A, 8B:
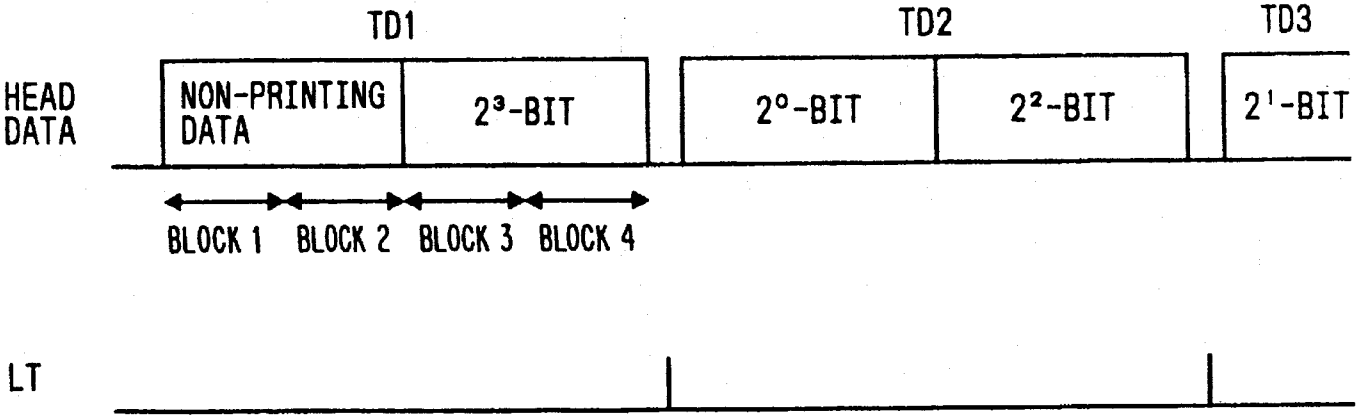
FIG. 8(*a*) is an enlarged view of head data of FIG. 7(*a*)

Furthermore, in a modification of the aforesaid embodiment of the present invention, the heat emitting elements of the thermal head can be divided (or partitioned) into blocks of a number (for example, 2) less than the number of the blocks of the thermal head of the aforementioned embodiment (namely, 4). Namely, one of such two blocks (hereunder referred to as a first block) of this modification corresponds to the combination of, for instance, the blocks B1 and B2 of the foresaid embodiment. Further, the other of such two blocks (hereunder referred to as a second block) of this modification corresponds to the combination of the blocks B3 and B4 of the foresaid embodiment. Further, energizing pulses EN1 and EN2 for energizing the first block of this modification are generated such that the starting point of each of the pulses EN1 and EN2 is the start time of the data transfer of the $2^0$-, $2^1$-, $2^2$- or $2^3$-bit and each of the pulses EN1 and EN2 has the corresponding pulse duration T0, T1, T2 or T3 as illustrated in FIG. 7(*c*). Moreover, energizing pulses EN3 and EN4 for energizing the second block of this modification are generated such that the end point of each of the pulses EN3 and EN4 is the end time of the data transfer of the $2^3$-, $2^2$-, $2^1$- or $2^0$-bit and each of the pulses EN3 and EN4 has the corresponding pulse duration T3, T2, T1 or T0 as illustrated in FIG. 7(*c*). Incidentally, as illustrated in FIGS. 7(*a*) and 8(*a*), the head data TD1 is the combination of non-printing data and the $2^3$-bit and the head data TD2 is the combination of the $2^0$-bit and the $2^2$-bit. Further, in FIG. 7(*a*), the head data TD3 is the combination of the $2^1$-bit and the $2^1$-bit. Moreover, the head data TD4 is the combination of the $2^2$-bit and the $2^0$-bit. Moreover, the head data TD5 is the combination of the $2^3$-bit and the non-printing data. Furthermore, a sum of the energizing times corresponding to the first and second blocks of this modification is set in such a manner not to exceed the data-transfer time. Thereby, the number of the blocks to be energized simultaneously can be further reduced. Further, the maximum head current can be reduced by half.

While the preferred embodiments of the present invention have been described above, it is to be understood that the present invention is not limited thereto and that other modifications will be apparent to those skilled in the art without departing from the spirit of the invention. The scope of the present .invention, therefore, is to be determined solely by the appended claims.

What is claimed is:

1. A gradational printing method for performing a gradational printing by energizing a plurality of heat emitting elements, which are arranged on a thermal head, correspondingly to respective bits of digital gradation data representing a gray level, the gradational printing method comprising the steps of:

dividing the plurality of heat emitting elements into two or more blocks; and energizing different ones of the blocks in response to different respective bits of the digital gradation data.

2. A gradational printing method for performing a gradational printing by energizing a plurality of heat emitting elements arranged on a thermal head correspondingly to respective bits of digital gradation data representing a gray level, the gradational printing method comprising the steps of:

dividing the plurality of heat emitting elements into two or more blocks; and energizing the blocks correspondingly to different bits of the digital gradation data, respectively, wherein each of the block is energized for an energizing time having a predetermined length corresponding to a bit of the digital gradation data, wherein the predetermined length corresponding to each of a $2^0$-bit and a $2^1$-bit of the digital gradation data is less than or equal to half of each data-transfer time required for transferring head data at a time, and wherein the step of energizing the blocks comprising the sub-steps of:

generating energizing pulses each having a pulse duration which is equal to the energizing time corresponding to each bit of the digital gradation data, an energizing pulse corresponding to the $2^0$-bit of the digital gradation data having a starting point thereof at a middle point of each data-transfer time, an energizing pulse corresponding to the $2^1$-bit of the digital gradation data having an end point thereof at the middle point of each data-transfer time; and energizing each of the blocks in response to a corresponding one of the energizing pulses.

3. A gradational printing method for performing a gradational printing by energizing a plurality of heat emitting elements arranged on a thermal head correspondingly to respective bits of digital gradation data representing a gray level, the gradational printing method comprising the steps of:

dividing the plurality of heat emitting elements into two or more blocks; and energizing the blocks correspondingly to different bits of the digital gradation data, respectively, wherein each of the blocks is energized for an energizing time having a predetermined length corresponding to a bit of the digital gradation data, wherein the step of dividing the plurality of heat emitting elements into two or more blocks comprises the sub-step of dividing the blocks into groups of a number which is less than a number of the blocks and is not less than two, and wherein the step of energizing the blocks comprising the sub-steps of:

generating head data comprising the bits of the digital gradation data, which bits correspond to the groups of the blocks, respectively;

generating energizing pulses each having a pulse duration which is equal to the energizing time corresponding to each of the bits of the digital gradation data, an energizing pulse corresponding to one of the groups of the blocks having a starring point thereof at a start of each data-transfer time, an energizing pulse corresponding to another of the groups of the blocks having an end point thereof at an end of each data-transfer time; and energizing each of the groups of the blocks in response to a corresponding one of the energizing pulses.

4. A device for controlling a thermal head for printing a gradational printing, a plurality of heat emitting elements being arranged on the thermal head and being divided into two or more blocks, the device comprising:

a gradation data memory for storing gradation data of at least one line to be printed;

an address counter, connected to the gradation data memory, for outputting address signals which indicate addresses of the memory, from which the gradation data should be read, and for outputting a latch pulse;

a transfer counter, connected to the address counter, for counting a number of times of outputs of the latch pulses from the address counter as a number of times of transferring head data to the thermal head and for outputting a signal indicating the number of times of transferring head data;

an energizing-pulse generating portion, connected to the address counter and the transfer counter, for storing energizing-time data representing an energizing time corresponding to each of the blocks of the heat emitting elements and to the number of times of transferring head data, for generating an energizing pulse corresponding to each of the blocks of the heat emitting elements, which pulse has a pulse duration being equal to the energizing time represented by the energizing-time data corresponding to the corresponding block and to the number of times of transferring head data, by comparing the address indicated by the address signal with the corresponding energizing-time data and for outputting the energizing pulses to the blocks of the heat emitting elements;

a decoder, connected to the address counter and the transfer counter, for storing selection data corresponding to the addresses and to the numbers of times of transferring head data and for outputting a selection signal representing selection data corresponding to the address signal and the signal outputted from the transfer counter; and a selector, connected to the gradation data memory and the decoder, for reading from the gradation data memory the gradation data corresponding to the addresses represented by the address signal outputted by the address counter, for generating head data by selecting a bit of the read gradation data, the bit position of the bit being indicated by the selection signal, and for outputting the head data to the thermal head.

5. The device for controlling a thermal head for printing a gradational printing according to claim 4, wherein the energizing-pulse generating portion comprises:

a read-only memory for storing the energizing-time data; and comparators, connected to the blocks of the heat emitting elements, respectively, each of the comparators generating the energizing pulse corresponding to the corresponding block by comparing the address indicated by the address signal with the corresponding energizing-time data and outputting the generated energizing pulse to the corresponding block.

6. The device for controlling a thermal head for printing a gradational printing according to claim 4, wherein the energizing-pulse generating portion comprises a single read-only memory, wherein the pulse duration corresponding to each of $2^0$-bit and $2^1$-bit of the digital gradation data is less than or equal to half of each data-transfer time required for transferring head data at a time, wherein the single read-only memory generates an energizing pulse corresponding to the $2^0$-bit of the digital gradation data having a starting point thereof at a middle point of each data-transfer time and another energizing pulse corresponding to the $2^1$-bit of the digital gradation data having an end point thereof at the middle point of each data-transfer time.

* * * * *